United States Patent [19]

Venturini, deceased

[11] Patent Number: 4,538,981

[45] Date of Patent: Sep. 3, 1985

[54] COMBUSTION CATALYZING SYSTEM FOR COMMERCIAL GRADE FUELS

[75] Inventor: Andrea Venturini, deceased, late of Verona, Italy, by Antonio Venturini, Silvana Venturini née Salea, Rossella Venturini, heirs

[73] Assignee: SO. CO. EN. S.r.l., Ferrara, Italy

[21] Appl. No.: 311,116

[22] Filed: Oct. 13, 1981

[30] Foreign Application Priority Data

Oct. 14, 1980 [IT] Italy ..... 84963 A/80

[51] Int. Cl.[3] ..... F23L 9/00; F23L 7/00

[52] U.S. Cl. ..... 431/190; 431/4; 431/12; 137/251

[58] Field of Search ..... 431/190, 12, 4, 85, 431/202, 354; 239/61, 533.2, 533.1; 137/251, 253, 254

[56] References Cited

U.S. PATENT DOCUMENTS

| | | | |
|---|---|---|---|
| 2,575,574 | 11/1951 | Withrow et al. | 137/251 |
| 4,127,379 | 11/1978 | Grove | 431/4 |
| 4,133,628 | 1/1979 | Morrison | 431/4 |
| 4,173,449 | 11/1979 | Israel | 431/190 X |
| 4,173,450 | 11/1979 | Schrank | 431/4 X |
| 4,242,076 | 12/1980 | Rawyler-Ehrat | 431/4 |
| 4,295,816 | 10/1981 | Robinson | 431/4 |
| 4,332,236 | 6/1982 | Stora et al. | 126/121 |

FOREIGN PATENT DOCUMENTS

| | | | |
|---|---|---|---|
| 9344 | of 1899 | United Kingdom | 137/251 |

*Primary Examiner*—Samuel Scott
*Assistant Examiner*—Kenichi Okuno
*Attorney, Agent, or Firm*—Guido Modiano; Albert Josif

[57] ABSTRACT

The invention relates to a combustion catalyzing system for commercial grade fuels. The system comprises a water reservoir which is fed with air through an inlet arranged to be immersed into the reservoir water. A vapor phase water outlet conduit is provided which extends from the reservoir top and is routed to a combustion zone to be catalyzed. Along the path followed by the vapor phase water which flows through the outlet conduit from the water reservoir, an oil-operated flow regulating device is provided which is effective to control the rate of emission of steam bubbles from the reservoir. Upstream of the flow regulating device, a motor-driven valve controlled by a humidistat located in the proximity of the combustion zone to be catalyzed may be provided for delivering a larger or smaller amount of steam to the flow regulating device. Advantageously, located downstream of the flow regulating device, a check valve is provided to prevent the backflowing of combustion gas from the combustion zone toward the flow regulating device.

2 Claims, 4 Drawing Figures

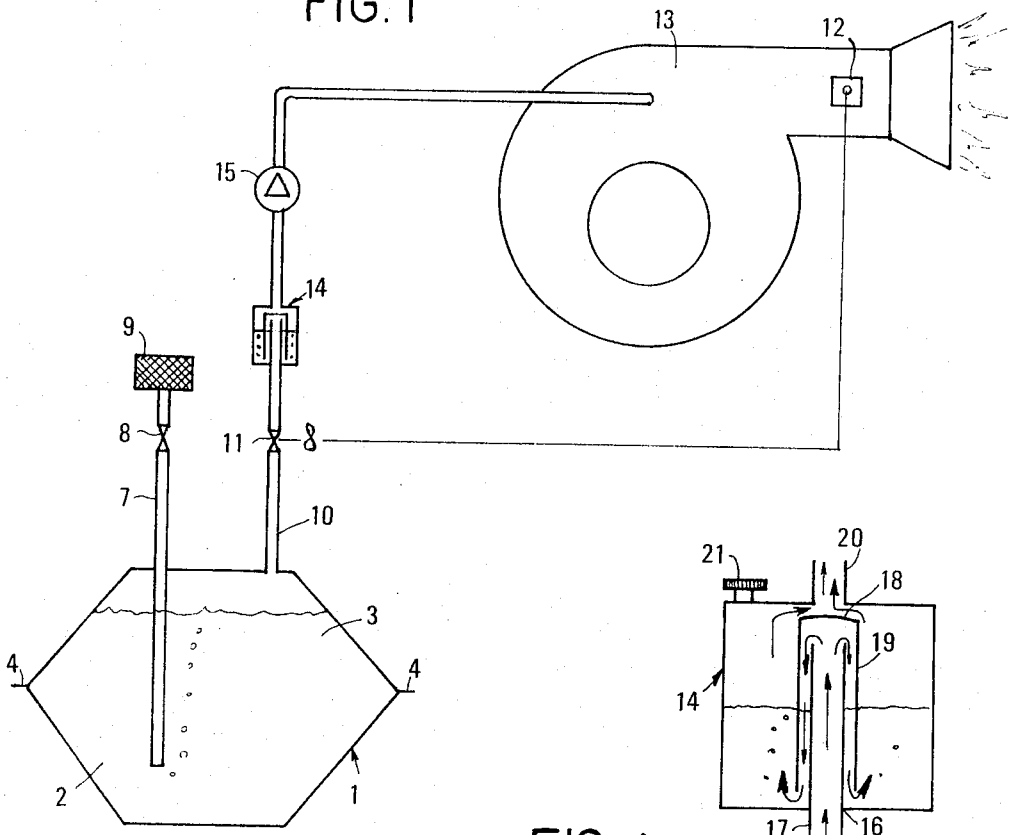
FIG. 1
FIG. 4
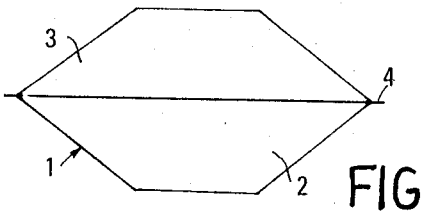
FIG. 2
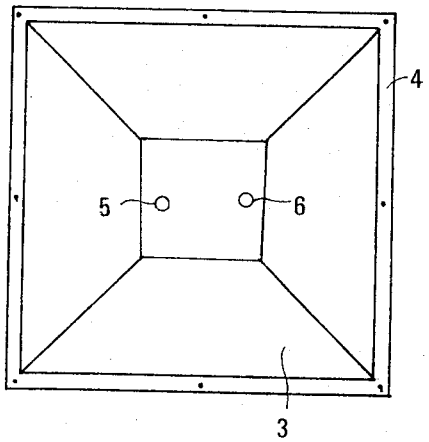
FIG. 3

COMBUSTION CATALYZING SYSTEM FOR COMMERCIAL GRADE FUELS

BACKGROUND OF THE INVENTION

This invention relates to a combustion catalyzing system for commercial grade fuels.

It is known that the energy output of a combustion system, or fossil fuel, can be increased by adding minute amounts of appropriately vaporized water, and perhaps of oil as well, to the combustion supporting air. This is frequently practiced in liquid or gaseous fuel burners for both domestic and industrial heating systems. A somewhat similar application can also be found on internal combustion engines. In general, this type of catalyzation is effected by bubbling air through a bubble forming circuit including a sealed water reservoir, wherein the water free surface is covered with a layer or film of oil. The scrubbing air generates bubbles in the body of water, and the bubbles ascend to then breach through the oil layer floating on the water. Thus, the oil performs the important function of acting as a valve element to control the size of the bubbles and their rate of emission (i.e. the number of bubbles per unit time). The bubbles entrain vaporized water therealong, which upon overcoming the barrier represented by the oil layer on the water are drawn into the combustion air supply conduit of a burner or engine to act as a combustion catalyst.

A substantial drawback of such bubble forming systems resides in their requisite for an oil having specific characteristics as regards density and viscosity, or otherwise the sizing and emission rate of the air bubbles through the body of water become impossible to control.

Moreover, the oil floating in the water partly emulsifies in time, which results in a decrease of the thickness of the oil layer left on the water surface, and consequently an alteration of the bubble rate of emission occurs, which may adversely affect the combustion output.

SUMMARY OF THE INVENTION

It is a primary object of this invention to provide a combustion catalyzing system for commercial grade fuels, which enables the feeding of vapor phase water to a combustion zone to be catalyzed at a rate and in accurately predictable and readily adjustable amounts to suit the conditions prevailing in the combustion zone.

Another object of the invention is to provide such a system, which requires neither, special oil nor any oil having preset viscosity characteristics for its operation, but which can operate on any oil.

It is a further object of this invention to provide such a system, which is economical to manufacture, easy to install, and has minimal maintenance requirements.

These and other objects, such as will be apparent hereinafter, are achieved according to the invention by a combustion catalyzing system for commercial grade fuels which includes a water reservoir, an air inlet conduit arranged to be immersed in the reservoir water, a vapor phase water outlet conduit extending from the reservoir top to a combustion supporting air line of a burner or engine the improvement wherein it further comprises in combination a humidistat located on the burner to measure the vapor content in the combustion supporting air entering the burner; a flow control valve disposed on the said outlet conduit and operated by the said humidistat to control the vapor flow in the outlet conduit depending upon the vapor content in the combustion supporting air; and a flow regulating device located on the said outlet conduit downstream of the said control valve for calibrating the flow of air and vapor depending upon the operating features of the burner.

BRIEF DESCRIPTION OF THE DRAWINGS

Further aspects and advantages of the invention will be more clearly understood from the following detailed description of a preferred but not limitative embodiment thereof, given here by way of example only and illustrated in the accompanying drawings, where:

FIG. 1 illustrates diagramatically a system according to the invention, as applied on a boiler type of burner;

FIG. 2 is a front elevation view of a reservoir;

FIG. 3 is a plan view of the reservoir shown in FIG. 2; and

FIG. 4 shows a schematic representation of a flow regulator incorporated in the system of FIG. 1.

DESCRIPTION OF THE PREFERRED EMBODIMENTS

With reference to the drawing figures, there is indicated at 1 a reservoir which is filled with water to three quarters of its capacity. The reservoir 1 is preferably made of a transparent plastics material and results from the juxtaposition (FIGS. 2 and 3) of two halves, a lower one 2 and upper one 3, in the shape of a square-based truncated pyramid. The two reservoir halves 2 and 3 are flanged as at 4 along their mating areas where they are held together by any suitable means, such as by an adhesive means, riveting, welding, and the like. Two throughgoing holes 5 and 6 are provided at the top of the half 3.

An inlet pipe 7 is intended for insertion through the hole 5 which extends into the reservoir 1 interior until its end locates at a short distance from the reservoir bottom, thereby the tube is caused to remain immersed in the water contained in the reservoir 1. Mounted in the conduit 7 is an on/off control valve 8, e.g. of the gate type, upstream of which is located a filter 9. The filter 9 is in turn fed by an aerator (not shown and formed, for example, by a small air pump), which is operative to supply a small amount of air to the inlet end of the filter 9. Such air is caused to flow through the valve 8 to then leave the conduit 7 and enter the body of water in the reservoir 1, thus forming, at a controlled rate, bubbles which are released above the free surface of the water contained in the reservoir 1.

The hole 6 is adapted for accommodating an outlet circuit 10 therethrough, which extends from the top of the reservoir 1 and includes a motor-driven valve 11 therein which is controlled by a humidistat, generally indicated at 12 and placed in the combustion supporting air pipe of a burner 13. Downstream of the valve 11, there is provided in the conduit 10 a flow regulating device 14, more clearly shown in FIG. 4. The outlet end of the device 14 is connected, via a check valve 15 and a combustion supporting air pipe, to a point on the burner 13 where combustion supporting air directed to the burner combustion chamber flows at a high speed. The combustion supporting air exerts, within the burner 13, a suction effect on the steam supply conduit 10 from the reservoir 1, which suction is applied downstream of the device 14.

As shown in FIG. 4, the flow regulating device 14 comprises a container of a transparent material, e.g. a plastics material, which is apertured as at 16 on the bottom to accommodate a conduit 17 therethrough, which constitutes an extension of the conduit 10 from the outlet end of the valve 11. The conduit 17 penetrates for a distance into the container of the device 14 as far as a point located in the proximity of the ceiling 18 of a bell element 19 placed over the end of the conduit 17. The interior of the device 14 is arranged to contain a proportioned amount of oil which reaches a given level also within the bell 19. The air entraining with it vapor phase water from the reservoir 1 through the conduit 17 is thus forced to flow through the passage formed between conduit 17 and bell 19 and thereby to flow twice through the layer of oil within the device 14. In fact the oil is forced to flow first downwardly within the bell 19 and afterwards upwardly toward an outlet conduit 20 leading to the check valve 15.

The device 14 is also provided with a filler cap 21 for the introduction of oil thereinto. Advantageously, the outer wall of the device 14 may be provided with an indexed scale for checking the level of the oil inside it. The device bottom, moreover, may be provided with a drain plug (not shown), which can be used both to replace the oil in the body of the device 14 and to bleed off any excess during the oil level adjusting operations.

The valve 15 can be a suitable check valve, and the valve 11 can be a motor-driven throttle valve.

As may be seen, the rate of emission of the bubbles through the body of water in the reservoir 1 depends on the pressure above the water surface and thus in the conduit 10. On the other hand, such pressure depends to a large extent on suction from the burner 13 which is applied to the conduit 10 via the flow regulating device 14. When, owing to suction from burner 13 pressure is reduced at the outlet conduit 20, i.e., within the device 14 outside the bell 19, the oil level within the bell 19 is lowered until it reaches a level where air containing water vapor can bubble through the oil towards the oil surface and the outlet conduit 20. Other things being equal, it is possible to control the number of bubbles emitted per second and, within limits, the size of the bubbles either by providing an appropriate amount of oil, i.e. by adjusting the oil level in the flow regulating device 14 or by using an oil having a proper viscosity, or both.

As a rule, if the available oil is a low viscosity one, larger bubbles, generally, tend to be produced and a higher level will be maintained to control the flow in the device 14, whereas if the oil happens to be a higher viscosity oil, then bubbles smaller in size tend generally to be obtained and the oil will be maintained at a lower level, while still retaining the desired rate of bubble emission.

Advantageously, in the reservoir 1, instead of water a water solution including 30 percent sodium chloride may be utilized. For the oil to be employed in the device 14, kerosene or diesel fuel may be advantageously used.

By setting the humidistat 12 for a humidity of approximately 80 percent, the valve 11 will open or close to a greater or lesser extent in accordance with the conditions prevailing within the combustion supporting air pipe leading to the burner 13, thereby it will supply a larger or smaller amount of steam into the combustion chamber, depending on the information picked up by the humidistat.

With a system according to the invention, an increase of up to 20% in the $CO_2$ content of the flue gases has been ascertained, which means an economy in fuel consumption which may reach in some cases 14 percent or more. Through an improved combustion efficiency, the amount of excess air which is normally supplied to the burner can be reduced, so that a further economy in fuel consumption may be achieved.

The invention as above described is susceptible to many modifications and variations without departing from its scope as defined in the appended claims.

Thus, as an example, a resistance heater may be provided within the reservoir 1 for maintaining the temperature of the water or aqueous salt solution within the reservoir 1 at a level preferably in the 20° to 30° C. range, and if necessary, avoiding freezing problems during the cold season.

In a practical embodiment of the system according to the invention, a reduction of about 7% of the excess air supplied to an oil burner has been achieved, and with a gas burner, a reduction of 5% of the air excess has been achieved.

Furthermore, a lower temperature has been observed in the flue gases as a result of optimum combustion conditions existing in the boiler. Of course, the reduction in the excess air is accompanied by an attendant lesser transfer of heat from the interior to the exterior of the boiler associated with the burner, while the fan supplying air to the burner can be operated at lower rpm, thereby giving the flue gases more time to transfer their heat to the water to be heated in the boiler.

Such an improved combustion also results in a drastic reduction of the unburned carbon compounds in the flue gases. This means a considerable reduction of the deposits which settle in the form of a layer that will cover the combustion chamber, the boiler interior, and the flue ducting, said reduction bringing about a longer retention of environmental conditions which favor a good thermal exchange between the hot combustion gases and the water to be heated.

Moreover, with a higher content of carbon dioxide in the flue gases, there also occurs a reduction in the polluting gas discharged to the atmsophere, and a longer life is ensured both for the boiler and flue.

It will be readily appreciated that, in addition to the two holes 5 and 6 in the upper portion of the reservoir 1, a third hole (not shown) may be provided to load water into the reservoir. Normally, said third hole is preferably closed by a plug.

Finally, and in general, the expression "humidity of about 80%", as stated in the example described hereinabove, is intended to include a range of values from about 60% to about 90%.

Naturally, besides on burners, a catalyzing system according to this invention may also be applied on internal combustion engines to increase their power output, and for a given performance, reduce their fuel consumption rate.

We claim:

1. In a combustion catalyzing system for commercial grade fuels, in which the combustion occurs in a burner or an engine, and which comprises a water reservoir, an air inlet conduit arranged to be immersed in the reservoir water to cause air to bubble through the water in the reservoir, a vapor entraining air outlet conduit extending from the reservoir upper portion to a combustion supporting air pipe leading to a combustion zone, a humidistat located at said combustion zone and arranged to detect the vapor content in the combustion supporting air entering the combustion zone, a flow control valve disposed on the said outlet conduit and operated by the said humidistat to control the vapor flow in the said outlet conduit, the improvement wherein it further comprises a flow-regulating oil-controlled device containing oil and having an adjustable oil content level and located on the said outlet conduit downstream of the said control valve, said oil-controlled device having means for adjusting said oil content level therein and means defining a passage through said oil for said vapor flow, the length of said passage depending upon said oil content level whereby the vapor-entraining air flowing through the said outlet conduit is controlled both by said oil-controlled device and by the said flow-control valve both in response to the oil content level in said oil-controlled device and in response to the humidity content in the said combustion supporting air respectively and is caused controllably to bubble through said oil in said flow regulating device in response to a suction effect of said burner or engine.

2. A combustion catalyzing system according to claim 1, wherein said oil-controlled device comprises a container having a top and a bottom with an aperture therein for said outlet conduit, said outlet conduit extending with an end portion thereof into said container up to a point at a distance from said bottom thereof, a bell element with a ceiling and sidewalls surrounding said end portion of said outlet conduit to define a vapor flow passage from said end portion of the outlet conduit towards said ceiling and from said ceiling along said sidewalls towards said bottom of the container, said container having a filler cap member on the top thereof for supplying therethrough oil up to said oil content level between said bell ceiling and said bottom said oil level thereby defining the length of said vapor flow passage through said oil and an aperture in said top of said container for said combustion supporting air pipe leading towards said combustion zone.

* * * * *